US005568660A

United States Patent [19]

Raburn et al.

[11] Patent Number: 5,568,660

[45] Date of Patent: Oct. 29, 1996

[54] WHEELCHAIR CUSHION AND COVER

[75] Inventors: Richard W. Raburn, Mauldin; Fred T. Wickis, Jr., Greer, both of S.C.

[73] Assignee: Span-America Medical Systems, Inc., Greenville, S.C.

[21] Appl. No.: 457,619

[22] Filed: Jun. 1, 1995

Related U.S. Application Data

[63] Continuation of Ser. No. 903,790, Jun. 24, 1992, Pat. No. 5,459,896.

[51] Int. Cl.[6] ..... A47C 27/14; A47C 31/02

[52] U.S. Cl. ..... 5/652.1; 5/900.5; 5/484

[58] Field of Search ..... 5/653, 481, 461, 5/468, 900.5, 903, 470, 473, 484, 482; 287/DIG. 1

[56] References Cited

U.S. PATENT DOCUMENTS

| | | | |
|---|---|---|---|
| D. 307,687 | 5/1990 | Raburn . | |
| D. 307,688 | 5/1990 | Schaefer . | |
| D. 307,689 | 5/1990 | Schaefer . | |
| D. 307,690 | 5/1990 | Raburn . | |
| D. 322,907 | 1/1992 | Raburn . | |
| 2,082,151 | 6/1937 | De Poix . | |
| 2,659,421 | 11/1953 | Wass | 5/473 |
| 2,785,739 | 3/1957 | McGregor | 5/481 |
| 3,284,817 | 11/1966 | Landwirth . | |
| 3,789,441 | 2/1974 | Weiss | 5/497 |
| 4,073,020 | 2/1978 | Stalter | 5/481 |
| 4,092,751 | 6/1978 | Burkholder et al. . | |
| 4,265,484 | 5/1981 | Stalter . | |
| 4,485,505 | 12/1984 | Paul . | |
| 4,522,447 | 6/1985 | Snyder | 5/653 |
| 4,539,057 | 9/1985 | Ahlm | 5/481 |
| 4,573,456 | 3/1986 | Spann . | |
| 4,646,374 | 3/1987 | Shafer | 5/653 |
| 4,686,725 | 8/1987 | Mitchell . | |
| 4,726,087 | 2/1988 | Schaefer et al. . | |
| 4,768,251 | 9/1988 | Baskent . | |
| 4,862,538 | 9/1989 | Spann et al. . | |
| 4,901,387 | 2/1990 | Luke . | |
| 5,007,123 | 4/1991 | Salyards | 5/473 |
| 5,007,124 | 4/1991 | Raburn et al. . | |
| 5,025,519 | 6/1991 | Spann | 5/481 |
| 5,079,790 | 1/1992 | Pouch | 5/481 |
| 5,160,785 | 11/1992 | Davidson | 5/481 |
| 5,193,237 | 3/1993 | Holdredge . | |

OTHER PUBLICATIONS

USPQ2d, Court of Appeals, Federal Circuit, pp. 2010–2016.

*Primary Examiner*—Flemming Saether
*Attorney, Agent, or Firm*—Dority & Manning

[57] ABSTRACT

Pressure relief for wheelchair patients is improved by use of a relatively higher density foam, such as 2.4 pounds per cubic foot or above and a 25 percent ILD characteristic of at least about 50 pounds, together with independently acting cube shaped segments. The segments have predetermined respective separation and rounded upper edges with a predetermined radius of curvature which is larger about the periphery of the wheelchair pad. A relatively lowered pad thickness of about 3 inches facilitates patient movement onto and off from a wheelchair cushion. A removable covering of laminated materials is stretchable so as to slide over the rounded edges of the segments and down into separations therebetween to maintain independent action of such segments during use with the covering. An upper layer of the covering comprises a base layer of woven fabric of elastic synthetic fibers. A lower layer of the covering comprises a water resistant coating of urethane generally at least about 1 mil thick. The stretchable covering features can be used separately with other forms of patient supports, such as mattress pads having convolutions or other forms of independent support segments with separations therebetween.

22 Claims, 5 Drawing Sheets

WHEELCHAIR CUSHION AND COVER

This is a continuation of application Ser. No. 07/903,790, filed Jun. 24, 1992 now U.S. Pat. No. 5,459,896.

BACKGROUND OF THE INVENTION

The present invention concerns in general an improved patient support, and in particular concerns supports having an improved stretchable covering and concerns improved wheelchair cushions of particular construction.

Decubitus ulcers, also known as bed sores, are a well-known and widespread problem and significant concern for bed-ridden patients or others who are constrained to prolonged periods of relative nonmovement, such as wheelchair patients. Pressure sores can begin to form due to prolonged or excessive pressure on the tissue, such as due to natural bony projections or prominences, which results in occlusion or blockage of capillary blood flow.

One common approach to addressing the foregoing concerns for patients having various stages or degrees of immobility is to provide pressure relief. Many typical approaches to pressure relief involve the use of resilient foamed materials formed for providing various specific patient support surfaces designed to alleviate or reduce tissue pressures.

One example of a specialized foam body support is shown by Spann (U.S. Pat. No. 4,573,456). FIGS. 1 through 3 illustrate a specialized resilient foam support for receiving the limb of an orthopedic patient. FIG. 4 of such '456 patent illustrates a rectangular generally flat block of synthetic foam with slits formed at right angles in an upper surface so as to form cubicle support members between intersecting rows of slits. Air channels are further provided at the base of the slits to conduct heat and moisture away from the patient for further enhanced prevention or treatment of pressure sores. The foam of such constructions would typically have a density of about 1.4 to about 1.8 pounds per cubic foot and a 25 percent indentation load deflection rating of about 44 pounds.

While the foregoing efforts have been effective to a degree, further improvement has been sought. For example, many relatively immobile patients also suffer from occasional, or even frequent, incontinence problems. For hygienic purposes, it is generally desirable that any foam support material be shielded from moisture, such as in the event of involuntary discharges of bodily fluids by a patient. For example, Landwirth (U.S. Pat. No. 3,284,817) discloses a waterproof sheath layer 20, formed such as from polyvinyl chloride, and heat sealed about a foam cushioned body 10. A further outer sheath is provided removably mounted and formed of a fabric material for washing. The removable cover is designed to fit snugly around the inner sheath.

One difficulty which in general may be encountered with coverings over segmented foam surfaces is referred to as the hammocking effect. During the hammocking effect, the advantages of the segmented support surface are lost, to varying degrees, because the covering itself tends to counter or defeat the independent movement of the support segments. Separately covering the independent segments would be one approach, but involves greater expense and can reduce the overall hygiene if personnel are not properly instructed in cleaning crevices between respective segments.

Other seat arrangements seek to improve body support by forming grooves of a certain depth in the face of a polyurethane foamed support, such as in hexagonal shapes or the like. Examples of such constructions are found in Stalter (U.S. Pat. No. 4,265,484); Burkholder et al. (U.S. Pat. No. 4,092,751); and Stalter et al. (U.S. Pat. No. 4,073,020). In the above-noted references, the hexagonal or other grooves are formed directly in the overall body support. In many instances of patient specific settings, the patient support provided for pressure relief is an added features to an existing device, such as a chair or wheelchair. Accordingly, any excessive thickness of the pressure relief support, for example, such as a cushion for a wheelchair, can create or add to difficulty of a patient getting into or out from the wheelchair.

The above-noted hammocking effect can also occur not only in specific pressure relief support devices such as wheelchair cushions, but can also be prevalent in the case of mattress pads or the like where a covering is to be utilized. Such can be the case in a wide variety of various segmented mattress pad surfaces, if improperly used with various coverings. Examples of prior art mattress pads with upper support surfaces having independent segments or otherwise independently movable projections are disclosed in:

| U.S. Pat. No. | INVENTOR |
|---|---|
| 5,025,519 | SPANN ET AL. |
| 5,007,124 | RABURN ET AL. |
| 4,901,387 | LUKE |
| 4,862,538 | SPANN ET AL. |
| 4,686,725 | MITCHELL |
| DES. 322,907 | RABURN |
| DES. 307,690 | RABURN |
| DES. 307,689 | SCHAEFER |
| DES. 307,688 | SCHAEFER |
| DES. 307,687 | RABURN |

In addition, other prior devices, such as head and neck pillows may make use of segmented support surfaces which would also be subject to the hammocking effect if improperly utilized with certain coverings. One example of a foam pillow construction for head and neck support is shown by Schaefer et al. (U.S. Pat. No. 4,726,087).

The disclosures of the above-referenced U.S. patents are fully incorporated herein by reference.

SUMMARY OF THE INVENTION

The present invention recognizes and addresses various of the foregoing problems, and others, concerning patient supports. Thus, broadly speaking, a principal object of this invention is improved patient supports. More particularly, one main concern is improved pressure relief support. Still further another main concern is providing an improved wheelchair cushion.

It is therefore another-particular object of the present invention to provide an improved pressure relief support for use by a seated patient such as in a chair.

It is another general object of the present invention to provide an improved patient support of a particular stretchable covering for conforming with independent support segments of a resilient foam body about which the covering is received. A more specific object of such an arrangement is an improved patient support combining the advantages of both the independent support segments of a given foam support and a covering therefor. It is a more specific object to provide such improved patient supports both in the area of specific devices such as wheelchair cushions and more generally in the area of mattress pads having independent support segments comprising either convolutions or other forms of independent segments such as generally rectangular shaped elements with air channels therebetween.

Still a further more particular object of this invention is to provide an improved wheelchair cushion which facilitates patient movement onto and off from a wheelchair by relatively minimizing the overall thickness of the cushion, while still advantageously preserving the enhanced support of independently responsive projections. It is another object to provide such an improved wheelchair cushion which may be usable with present covering features, including elastic response of such covering for conforming with independent movement of the support projections. Hence, it is a present object to provide an improved patient support, such as a wheelchair cushion, which has advanced foam support pad features for independent segmented support of the patient and combined therewith advanced covering features for protection of the pad with maximized function of the aforementioned independent support segment pad features.

Additional objects and advantages of the invention are set forth in, or will be apparent to those of ordinary skill in the art from, the detailed description which follows. It should be further appreciated that modifications and variations to the specifically illustrated and discussed materials or features hereof may be practiced in various embodiments and uses of this invention without departing from the spirit and scope thereof, by virtue of present reference thereto. Exemplary variations may include, but are not limited to, substitution of equivalent means, features or materials for those shown or discussed, and the functional or positional reversal of various parts, features, or the like.

Still further, it is to be understood that different embodiments, as well as different presently preferred embodiments, of this invention may include various combinations or configurations of presently disclosed features, elements, or their equivalents (including combinations of features or configurations thereof not expressly shown in the figures or stated in the detailed description). One exemplary such embodiment of the present invention relates to an improved pressure relief support for use by a seated patient such as in a chair, comprising a generally rectangular support pad comprised of resilient foam material, and having a predetermined thickness in a range of from about 5 to about 10 centimeters, a generally planar bottom surface on one side thereof, and a plurality of generally cube shaped elements integrally formed with the pad on an opposite side thereof and defining a support pad upper surface, such cube shaped elements being respectively separated from adjacent such elements by a predetermined distance for relative independent movement thereof and having curved edges adjacent to the support pad upper surface which have a predetermined radius of curvature; and a removable elastic covering received over at least the support pad upper surface and stretchable at least part way into the element separations over the element curved edges whenever the pad is sat upon by a patient, such covering comprising a laminated construction of at least two layers, including a first layer turned generally away from the support pad and a second layer turned generally towards the support pad.

In the foregoing exemplary construction, the covering first layer preferably comprises an elastic synthetic layer which is relatively stretchable in at least one direction, and the covering second layer comprises a generally water resistant coating of urethane applied to the first layer for stretching therewith. The support pad resilient foam material preferably has a density generally in a range of from about 2.4 to about 3.0 pounds per cubic foot and a 25 percent ILD characteristic in a range of from about 50 to about 60 pounds. The 25 percent ILD stands for 25 percent indentation load deflection, which is defined by the number of pounds of pressure required to push a 50 square inch plate into the support pad so as to compress same by 25 percent of its predetermined thickness.

Another present exemplary embodiment concerns a patient support comprising a body of resilient foam material defining at least one main patient support surface thereon, such surface defining a plurality of independent support segments with respective separations therebetween; and a stretchable covering for the body including the one main patient support surface thereof, such covering defining a base layer of woven fabric comprised of elastic synthetic fibers and a water resistant coating layer on the base layer, which is stretchable with the base layer so that such stretchable covering can stretch into separations between the independent support segments so as to permit independent action thereof whenever the patient support receives a patient on the body main patient support surface.

Yet another construction comprising a present exemplary embodiment includes an improved wheelchair cushion comprising a generally rectangular body of resilient foam material having a predetermined thickness of about 6 to about 9 centimeters, a density of at least about 2.5 pounds per cubic foot, a 25 percent indentation load deflection rating of at least about 50 pounds, and an upper support surface comprised of a plurality of projections extending though about one-half the thickness of the body, such projections further having adjacent relatively rounded edges at the upper support surface with a predetermined radius of curvature for the adjacent edges of at least about 5 millimeters, and having peripheral relatively rounded edges about the periphery of the upper support surface with a predetermined radius of curvature for the peripheral edges of at least about 10 millimeters, and further having a predetermined separation distance between adjacent projections of at least about 2 millimeters. With such an arrangement, the plurality of projections provide improved independent action and support of a patient thereon while overall thickness of the body is relatively minimized to facilitate patient movement onto and off from a wheelchair with which such cushion is used.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
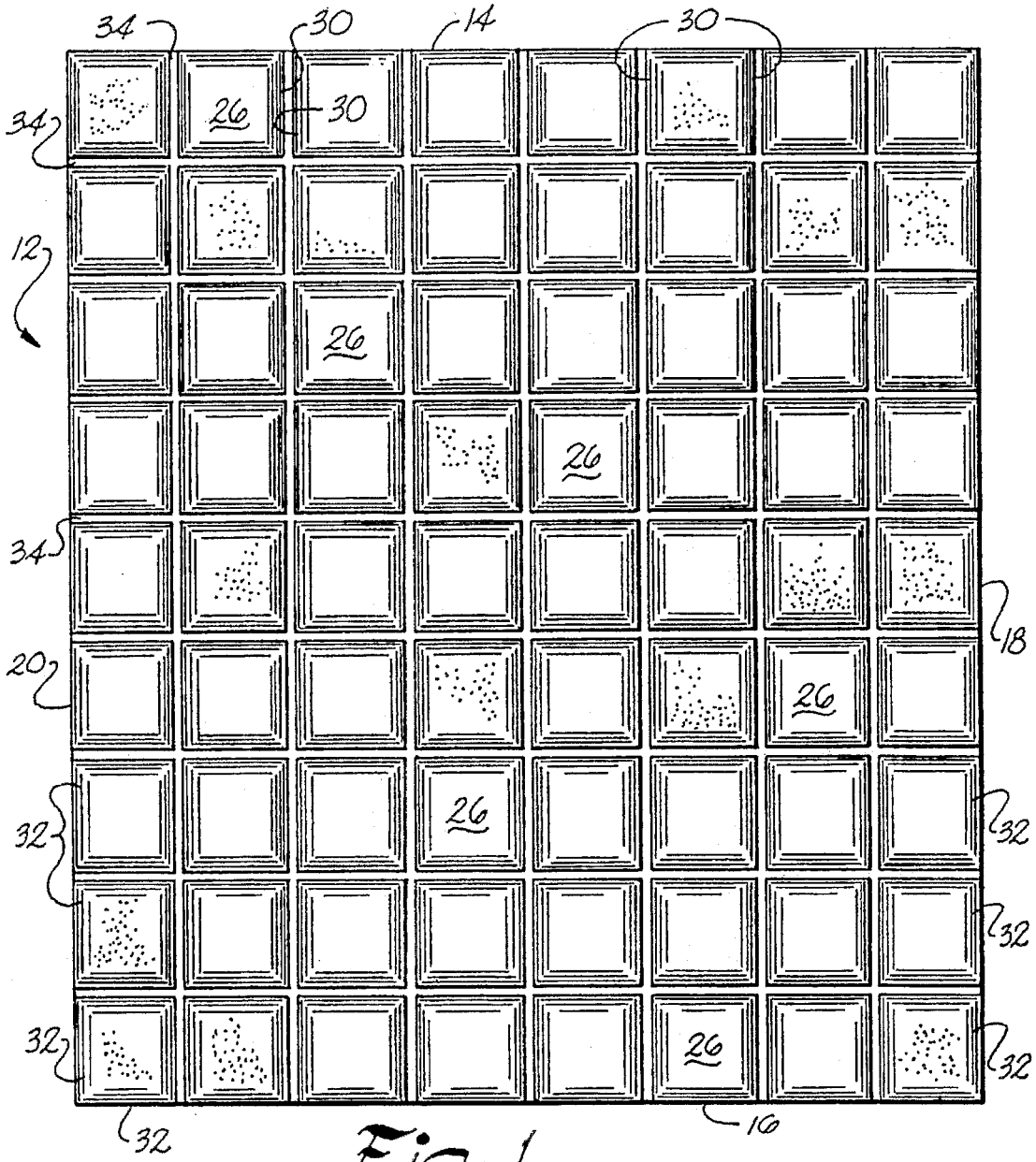
FIG. 1 is a top plan view of an exemplary embodiment of an improved support pad in accordance with the subject invention.

Repeat use of reference characters throughout the present specification and appended drawings is intended to represent same or analogous features or elements of the invention.

DETAILED DESCRIPTION OF THE PREFERRED EMBODIMENTS

Figure 2:
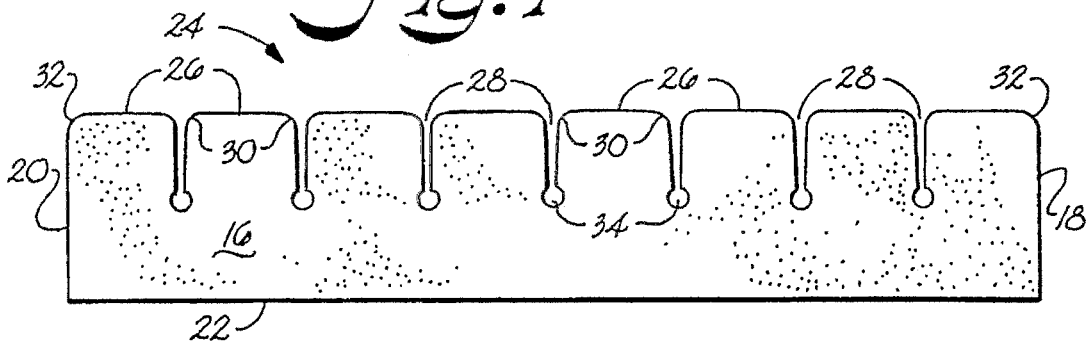
FIG. 2 is a front side elevational view of the embodiment of present FIG. 1, which is a mirror image of the rear side elevational view thereof.
Figure 3:
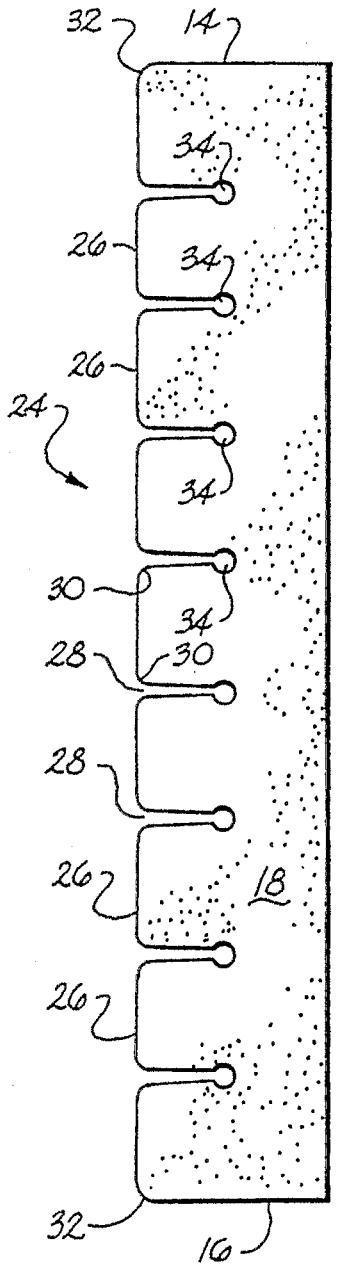
FIG. 3 is a right side elevational view of the embodiment of present FIG. 1, which is a mirror image of the left side elevational view thereof.

It will be appreciated by those of ordinary skill in the art that the following description is by way of specific examples only and does not preclude the practice of variations and embodiments which come within the broader aspects of the present invention. With reference to one present exemplary embodiment, FIG. 1 represents a top plan view of a generally rectangular body 12 of resilient foam material having respective pairs of lateral sides 14, 16, 18, and 20. FIG. 2 illustrates a front side elevational view (side 16) of the embodiment of present FIG. 1, which is identical in appearance to opposite side 14 thereof. FIG. 3 illustrates a right side elevational view (side 18) of the embodiment of present FIG. 1, which is identical in appearance to the opposite lateral side 20 thereof.

The body 12 of resilient foam material may include a generally planar bottom surface 22 on one side thereof (FIGS. 2 and 3) and an upper main patient support surface generally 24 opposite to the lower surface 22. Such surface 24 has defined therein a plurality of independent support segments 26 with respective separations generally 28 therebetween. Such an arrangement permits generally independent response of each segment or projection 26 to loading conditions thereon, i.e., receipt of a patient.

While various constructions of projections 26 may be practiced, generally cube shaped element are preferred in the present embodiments, such as discussed in greater detail below with reference to present FIG. 4. However, as is discernable from present FIGS. 1 through 3, the projections 26 have edges 30 adjacent to upper support surface 24 which are relatively rounded. Moreover, such edges 30 are respectively adjacent to one another and have a preferred predetermined radius of curvature. Such an arrangement further facilitates independent movement of respective projections 26.

As further represented in present FIGS. 1 through 3, the periphery of upper support surface 24 is also formed by rounded edges 32 of projections 26. Not only do such relatively rounded edges 32 have a preferred predetermined radius of curvature, but such radius of curvature is preferably in some embodiments somewhat larger than the radius of curvature for the curved edges 30 which are internal to the periphery o. support pad upper surface 24.

Though different constructions may be practiced, one presently preferred wheelchair embodiment of an improved cushion 12 in accordance with the subject invention may include 8 and 9 rows of projections 26 along respective lateral sides 16 and 18 thereof, as represented by present FIGS. 2 and 3, respectively. While different sizes may be practiced, in FIG. 2, the exemplary length of side 16 (i.e., the distance between opposing sides 20 and 18) may be generally in a range from about 35 to about 45 centimeters. At the same time, opposite side 14 would have similar dimensions.

The length of side 18 of present FIG. 3 may likewise vary, but in one exemplary embodiment preferably is in a range generally from about 40 to about 50 centimeters, between opposing sides 16 and 14 thereof. Opposite side 20 is generally of corresponding length.

Figure 4:
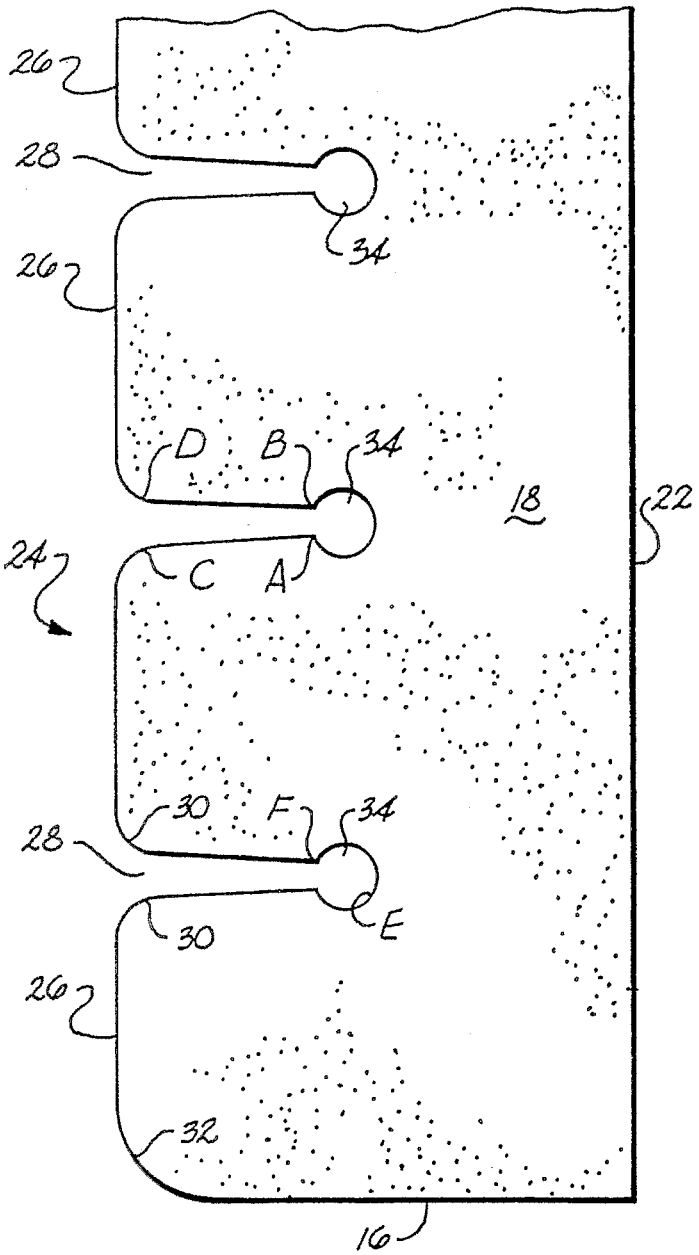
FIG. 4 is an enlarged side elevational view of the left hand end of the illustration of present FIG. 3.

FIG. 4 is an enlarged view of the left hand end of the illustration of present FIG. 3, to facilitate detailed discussion of various exemplary dimensional and other characteristics of body 12. It is to be understood that specific embodiments may include dimensions and characteristics which fall outside the exemplary dimensions and characteristics discussed hereinafter, while falling within the broader teachings of the subject invention.

Body 12 preferably comprises resilient foam material having a relatively higher density such as in a range of about 2.4 to about 3.0 pounds per cubic foot. In some embodiments, the density is preferably at least about 2.5 pounds per cubic foot, and in one preferred embodiment is about 2.8 pounds per cubic foot.

Support characteristics are likewise determined by indentation load deflection. A 25 percent indentation load deflection rating of at least about 50 pounds, and in one example in a range of about 50 to about 60 pounds, is preferred. A 25 percent ILD characteristic means a 25 percent indentation load deflection rating, which is defined by the number of pounds of pressure required to push a 50 square inch plate (generally a circular plate) into the support pad so as to compress same by 25 percent of its original (i.e., uncompressed) predetermined thickness. In the exemplary embodiment of a pad having 2.8 pounds per cubic foot density, an exemplary preferred 25 percent ILD characteristic is about 55 pounds.

The foregoing support characteristics of the resilient foam material itself advantageously permit an overall relative reduction or minimization of the thickness of support pad 12 (i.e., the distance between bottom side 22 and top side 24 thereof). A predetermined thickness in a range of about 5 to about 10 centimeters is preferred for some embodiments, and within a closer range of about 6 to about 9 centimeters is preferred for other embodiments. In one specific exemplary embodiment, a thickness of about 3 inches is preferred, which equates to approximately 7.62 centimeters. The relatively lessened thickness of a pad coming within such ranges, and particularly at a thickness of about 3 inches, facilitates patient movement, such as that of a wheelchair patient, onto and off from a chair, such as a wheelchair, with which the cushion is used.

As further represented in present FIG. 4, the overall height of the projections 26 in relation to the thickness of pad 12 is approximately one-half of such thickness. The FIG. 4 illustration is generally intended as being drawn to scale, at least with respect to relative relationships between various features.

As shown, the internal edges have a radius of curvature 30 which is preferably smaller than the radius of curvature of peripheral rounded edges 32. In general, all such rounded edges preferably have a radius of curvature of at least about 5 millimeters. A preferred range of the radius of curvature for rounded edges 30 may generally come within about 8 to about 12 millimeters, with one preferred specific exemplary embodiment being 10 millimeters (which is the same as 1.0 centimeter). The radius of curvature of peripheral rounded edges 32 is preferably in certain embodiments at least about 10 millimeters, and more preferably comes within a range of about 16 to about 22 millimeters. In one specifically preferred exemplary embodiment, a radius of curvature for rounded edges 32 is set at about 19 millimeters (which is the same as 1.9 centimeters).

Another preferred present feature of pad 12 is the optional inclusion of air channels 34 adjacent to the respective bases of projections 26, i.e., the area of projections 26 where such are integrally formed with body 12. As represented in present FIGS. 1 through 4, such air channels may also be regarded as residing at the bottom of the separations 28 between adjacent projections 26, and extending throughout the body 12 to lateral sides thereof. With such an arrangement, air channels 34 function so as to disperse or carry off heat and moisture from a patient received on main patient surface 24. Such function advantageously contributes to the prevention or reduction of pressure sores, as noted above.

As further represented by present FIG. 1, such air channels 34 also define a criss-cross pattern of parallel air channels in two separate directions which are mutually perpendicular. The projections 26 are in essence defined by the intersections of such air channels 34, as further evident from present FIG. 1.

As particularly evident from present FIGS. 2 through 4, such air channels 34 preferably have a circular cross section which not only aids in performance of their respective functions, but which also readily facilitates manufacture thereof with a CNC machine such as of the type and operation which are well known to those of ordinary skill in the art without further detailed description thereof. While various circular diameters for air channels 34 may be practiced, generally speaking, a diameter of at least about 5 millimeters is preferred, with some embodiments more preferably having a diameter in a range of from about 6 to about 9 millimeters. In one specific preferred exemplary embodiment, a diameter of about 7.9 millimeters may be practiced.

As still further represented throughout present FIGS. 1 through 4, and particularly by present FIG. 4, the predetermined distance of separation between adjacent projections 26 is such in accordance with the subject invention that independent action of segments 26 is clearly established. In some embodiments, a predetermined distance of separation of at least about 2 millimeters is preferred, and in still further embodiments, a predetermined separation distance of at least about 3 centimeters is preferred.

As FIG. 4 also represents, the predetermined separation between adjacent projections 26 relatively increases from adjacent the base thereof (near to air channels 34, when used) towards the upper support surface 24 thereof. In one embodiment, the smallest length of separation, i.e., the distance between points A and B in present FIG. 4, is preferably at least about 3 millimeters, while the largest degree of separation (i.e., the distance between points C and D of present FIG. 4) is about 5 millimeters. Variations may be practiced, and the indicated dimensions and locations of points A through D are intended to represent the relatively straight line portions of separations 28. In other words, such distances are not intended as encompassing any of the radius of curvature of adjacent curved edges 30.

In the exemplary configuration of present FIG. 4, the distance between bottom surface 22 and the bottom point E of air channel 34 is about 3.7 centimeters. For the same embodiment as shown in present FIG. 4, the distance between bottom surface 22 and the generally top portion of air channel 34, as represented by points A or B, is about 4.45 centimeters. Other dimensions may be practiced.

While different configurations of projections or segments 26 may be practiced, generally cube shaped projections are preferred, having some predetermined lateral side length. For example, the distance between points A and F of present FIG. 4 may generally fall into a range of from about 3.5 to about 5.5 centimeters, with one specific presently preferred embodiment comprising about 4.5 centimeters at such length. The dimension of a projection 26 perpendicular to the dimension between points A and F thereof (and parallel to the air channel 34) may be the same as that between points A and F, or may alternatively otherwise come within the range noted above while differing from the specific exemplary length between points A and F.

Those of ordinary skill in the art will appreciate from the description and disclosure above that a support pad 12 advantageously provides for independent support segments on at least one main patient support surface 24 thereof, while otherwise minimizing the relative thickness of such body 12 so as to facilitate patient movement onto and off from such cushion.

Figure 5:
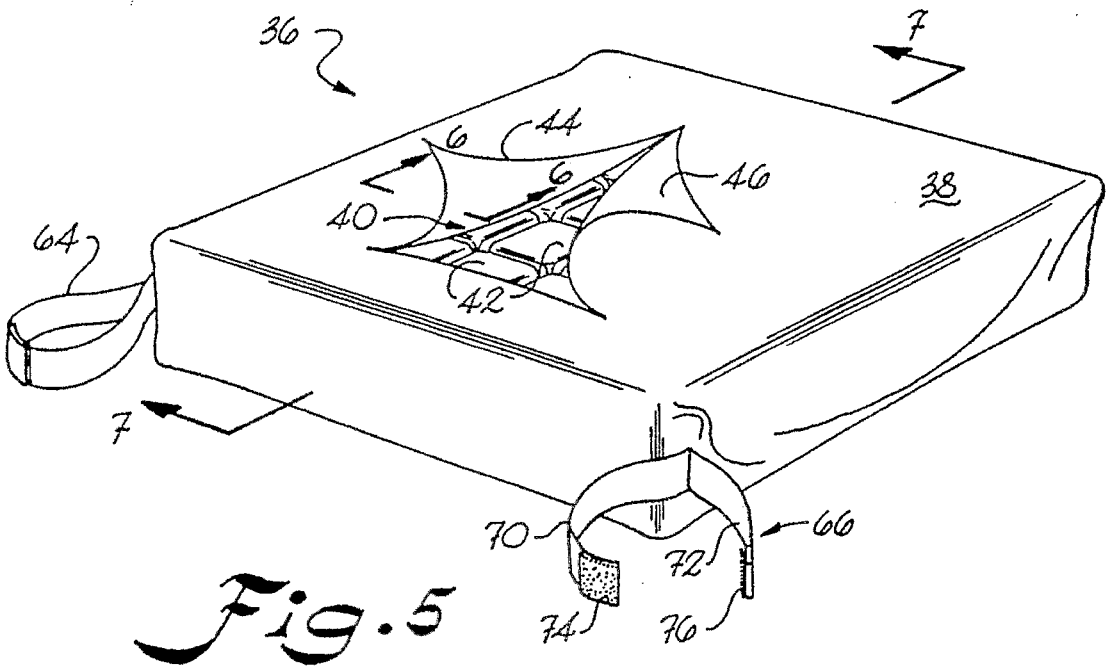
FIG. 5 is a generally raised perspective view of an improved pressure relief support in accordance with the subject invention, including in combination both present support pad features and present removable elastic covering features of this invention, with covering features thereof in partial cut-away for illustrating support pad features internal thereto.

FIG. 5 illustrates a generally raised elevational view of an exemplary patient support generally 36 in accordance with this invention. Such an embodiment may include a combination of a support pad 12 (as discussed above with reference to FIGS. 1 through 4) with a covering means generally 38. In some embodiments, particularly of an improved wheelchair cushion having a construction of a support pad as with present pad 12, cover means 38 may comprise a generally water resistant cover received about the full rectangular body 12. In other present embodiments, a body generally 40 of resilient foam material defining at least one main patient support surface thereon including a plurality of independent support segments 42 with respective separations therebetween may be combined with a stretchable covering 38 in accordance with the subject invention. FIG. 5 illustrates portions 44 and 46 of such a covering 38 peeled back so as to reveal the body 40 of resilient foam material therein. Those of ordinary skill in the art will understand that such sections 44 and 46 would not be otherwise found in covering 38, except for present illustration purposes.

Figure 6:
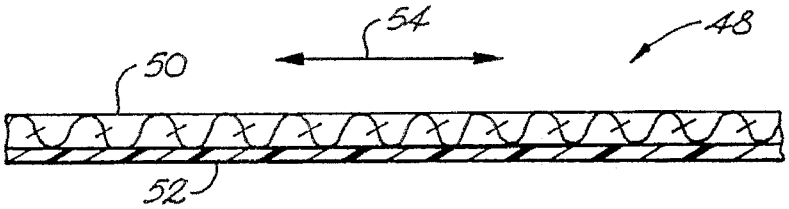
FIG. 6 is a cross-sectional view of a portion of the covering features of present FIG. 5, taken along sectional line 6—6 therein.

A stretchable covering in accordance with some embodiments of the subject invention preferably covers at least the main patient support surface defined by support segments 42 of the exemplary foam body 40. Present FIG. 6 illustrates a cross section of such an exemplary stretchable covering generally 48 in accordance with the subject invention taken along the sectional line 6—6 of section 44 of present FIG. 5. As shown in such FIG. 6, stretchable covering 48 preferably includes a main or base layer 50 of woven fabric such as comprised of elastic synthetic fibers. Such main layer 50 may also be considered as constituting a first layer which is turned generally away from the support pad or foam body 40.

Turned towards such support pad 40 is a second layer generally 52, which may also be regarded as comprising a preferably water resistant coating layer received on the base layer 50. Coating layer 52 is preferably stretchable with base layer 50 so that the stretchable covering 48 can stretch into separations between the independent support segments 42, thereby permitting independent action of such segments 42 whenever a patient is received on the patient support surface formed by such segments 42.

Figure 7:
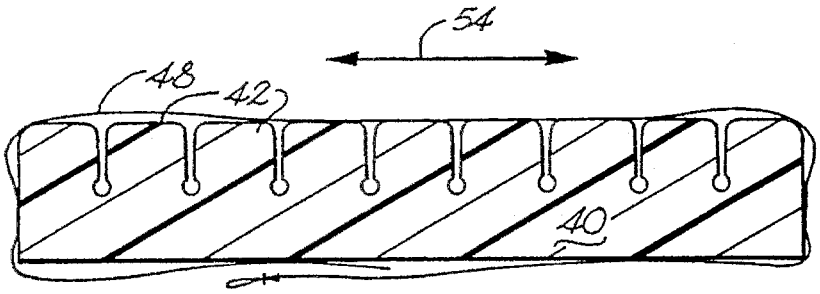
FIG. 7 is a full cross-sectional view of the embodiment of present FIG. 5, taken along the sectional line 7—7 therein.

FIG. 7 represents a further sectional view of the embodiment of present FIG. 5 taken along section line 7—7 thereof. As shown, stretchable covering 48 is preferably removably received about the entirety of inner pad 40, as opposed to just around support segments 42 thereof. Additional details of the indicated fabric stitching are not necessary for a complete understanding of the subject invention; in any event, alternate stitching details may be practiced as will be apparent to those of ordinary skill.

The upper or first layer 50 of covering 48 preferably comprises an elastomeric or elastic base layer. Woven material such as comprising 100 percent polyester may be used. In one embodiment, the woven material may be formed into a 70 denier warp knit. Any of various elastic textile fibers may be utilized. One example of an acceptable material is an elastic fiber sold under the trade name "Lycra" by Dupont. Spandex materials comprising elastic synthetic fibers may also be utilized.

As noted above, it is generally desired that covering 48 comprise a stretchable covering. Accordingly, in one embodiment of such covering 48, a two-way Rochelle knit may be practiced so as to render the elastic synthetic layer relatively stretchable in at least one direction, as represented by double-headed arrow 54 of present FIGS. 6 and 7. In other embodiments, a four-way Rochelle knit may be practiced for rendering the stretchable covering 48 relatively stretchable in a least two directions mutually perpendicular to one another. The added cost of such constructions over a two-way Rochelle knit is significant, and for many applications, such as wheelchair cushions, the performance of a covering relatively stretchable in at least one direction only has been found to be adequate.

The lower coating layer 52 of stretchable covering 48 preferably comprises a water resistant or water proofing layer. One example of such would be a coating of urethane, such as a coating of polyurethane. Heat bonding or other techniques may be practiced for producing a laminated two-layer covering 48, with preferably a thickness of at least about 1 mil or greater of urethane. One available coating which has adequate stretch characteristics for matching the stretching of top layer 50 is a clear urethane coating available under the trade name "Fabuthane" from Fabrite Laminating Corporation of Wood-Ridge, N.J. 07075. Other coating layers may be practiced, preferably so long as second layer 52 stretches with first layer 50.

Those of ordinary skill in the art will appreciate and understand from the present disclosure and discussion that additional coatings or functions of the various coatings may be alternately incorporated. For example, flame retardant coatings may be applied to an elastic covering 48 in accordance with the subject invention, without departing from the spirit and scope thereof.

Additionally, such an elastic covering may be utilized not only with an exemplary configuration of a foam support 40 as illustrated in present FIG. 5, but such FIG. 5 is also intended as representing combinations of such covering with other foam supports, such as incorporated by reference above in conjunction with the United States patents cited in the background of the invention. For example, present embodiments of the subject invention may include combinations of elastic covering 48 with exemplary mattress pad configurations incorporated above by reference. Such pads may be either of the type comprising convolutions for independent support segments on a patient support thereof, or comprising other projections such as exemplary generally rectangular shaped elements with air channels therebetween.

Figure 8:
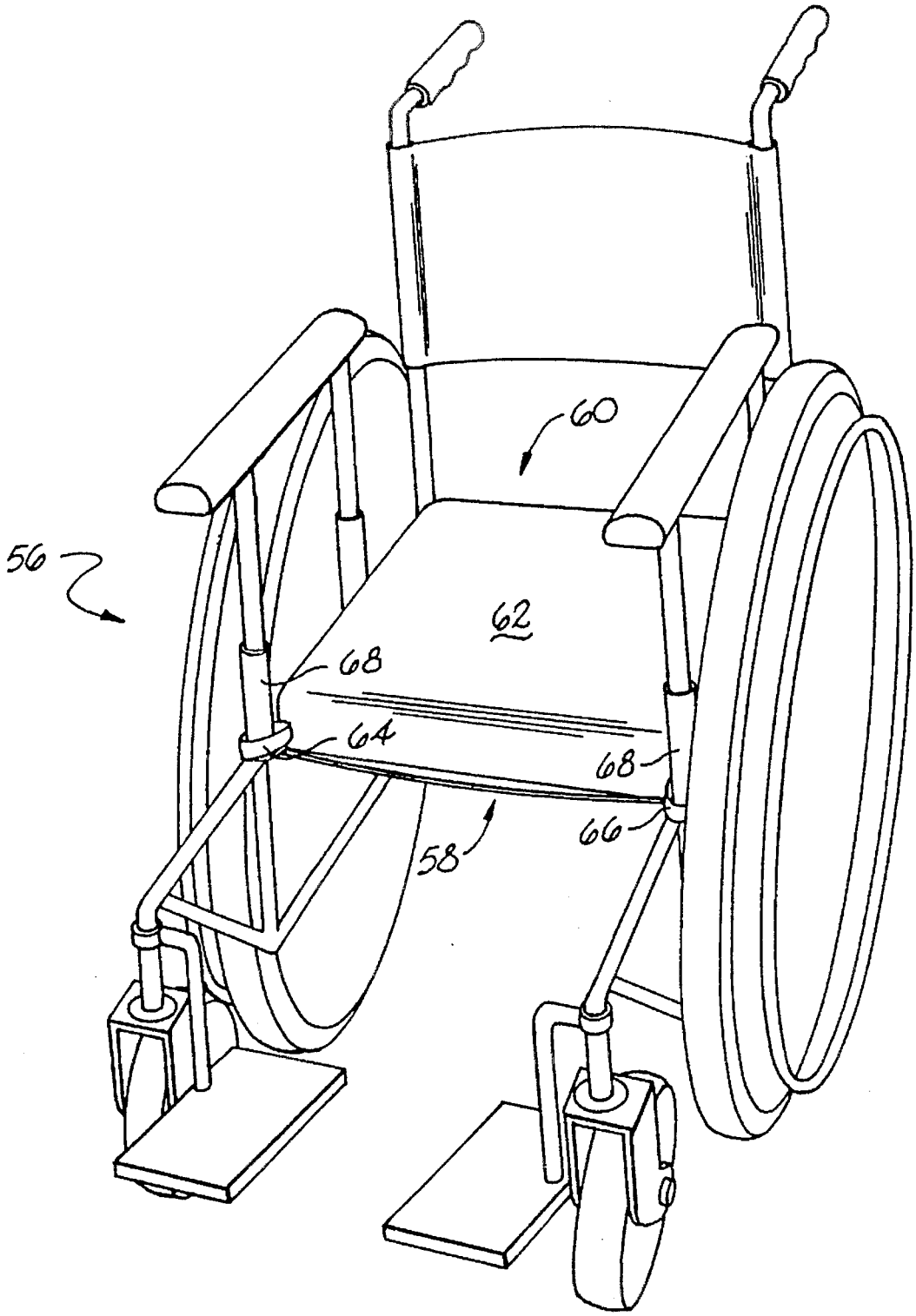
FIG. 8 is a generally front perspective view of a conventional wheelchair in combination with an exemplary embodiment of an improved wheelchair cushion or improved pressure relief support in accordance with the subject invention.

FIG. 8 is a generally front perspective view of a conventional wheelchair construction generally 56, the details of which are well known to those of ordinary skill in the art and which form no particular aspects of the present invention. Generally speaking, a conventional wheelchair has a support seat surface 58 upon which a patient is seated. In accordance with the subject invention, an exemplary improved pressure relief support or wheelchair cushion generally 60 is received on such support area 58.

In the exemplary embodiment 60 of present FIG. 8, a covering 62 is utilized in conjunction with a foam body contained therein, either in accordance with foam body 12 or some other configuration of a foam body in accordance with the subject invention, or of other design (whenever an elastic or stretchable covering 48 in accordance with this invention is practiced). The covering 62 completely surrounds such support pad and further includes associated therewith handle means 64 and 66 which may be used for securing the pressure relief support 60 to a support brace 68 or similar element of an associated chair or wheelchair 56 with which pressure relief support 60 is used. As further represented in present FIG. 5, such handle means may comprise various constructions, such as separable members 70 and 72 which may be removably joined with hook and loop closures 74 and 76, such as of the Velcro-brand type construction. Other forms of removable closures, such as snaps, hooks, or the like may be practiced.

Figure 9:
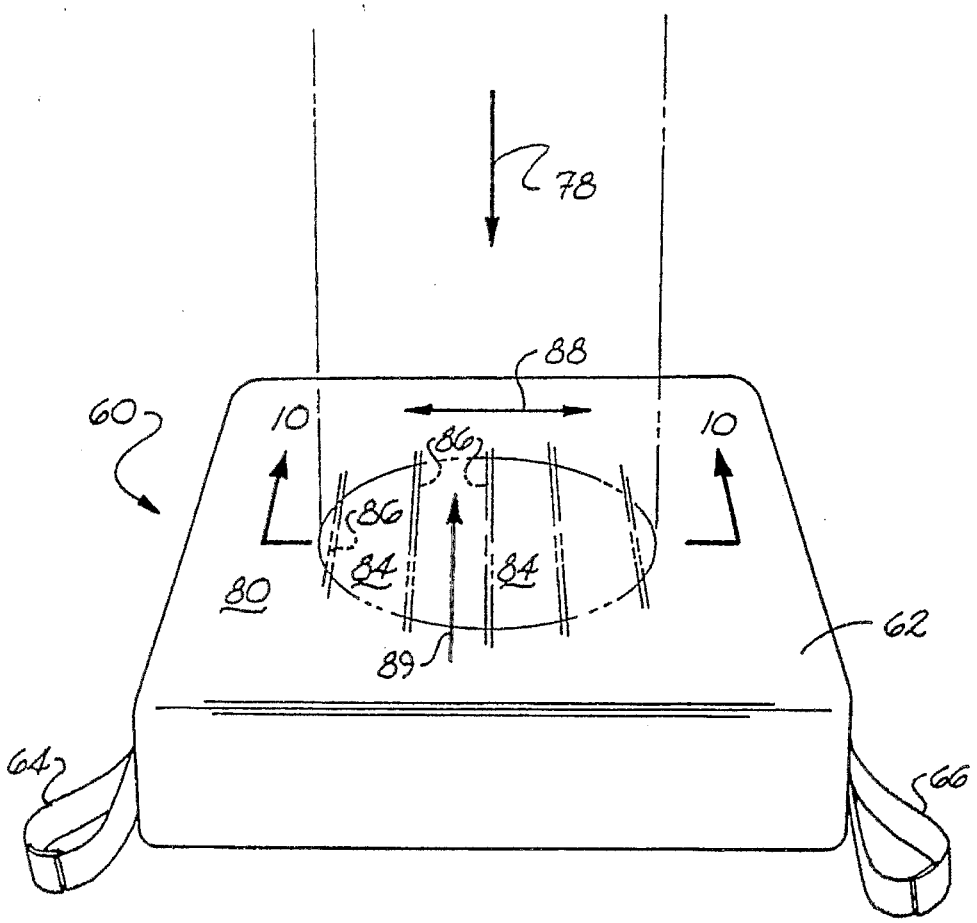
FIG. 9 is an isolated generally front and raised elevational view of a present exemplary embodiment of the subject invention as shown in present FIG. 8.

FIG. 9 illustrates a generally front and slightly raised perspective view of the patient support 60 in accordance with the subject invention. Illustrated by way of example therein is a representation of a column of force (arrow 78) received in a generally downward direction on an upper surface 80 of such construction 60 which includes a covering 62 in accordance with this invention.

Figure 10:
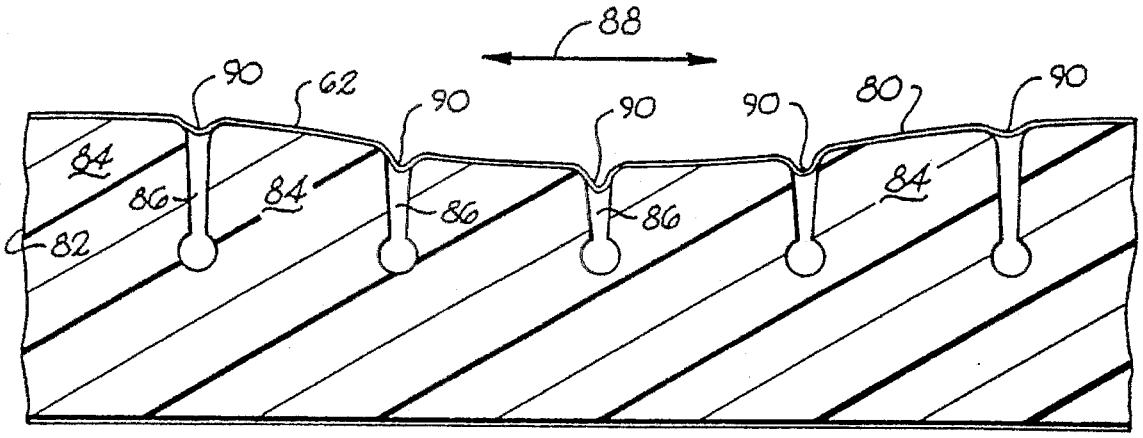
FIG. 10 is an isolated sectional view of the embodiment of present FIG. 9, taken along sectional line 10—10 therein, and illustrating operation of certain present features in conjunction with support of a patient thereon.

FIG. 10 is a partial cross-sectional view of the FIG. 9 embodiment taken along section line 10—10 therein. As shown, a support pad 82 has an elastic covering 62 in accordance with this invention received over a plurality of projections 84 formed in a patient support surface thereof. A plurality of separations 86 (FIGS. 9 and 10) are formed in parallel and at least in one direction between respective projections 84. As will be understood by those of ordinary skill in the art, separations (not illustrated) may be formed in a direction generally perpendicular to the illustrated separations 86.

In accordance with this invention, elastic covering 62 is relatively stretchable in at least one direction (double-headed arrow 88 of present FIGS. 9 and 10) which is generally perpendicular to the separations 86 running in one given direction (arrow 89) of the support pad 82. By such an arrangement, stretchable covering 62 may stretch into the separations 86 so as to be at least partly received therein in response to a column of force 78 applied to surface 80, all as represented by the respective stretched portions 90 shown in present FIG. 10. As further presented in present FIG. 10 elastic covering 62 stretches differentially (i.e., by different amounts) in response to the amount of force. Generally speaking, a greater concentration of force (such as closer to arrow 78) results in a greater amount of stretch, while a lesser degree of force (further away from arrow 78) results in a lesser degree of stretch, as illustrated.

It will be understood from the foregoing description and disclosure that various embodiments of the subject invention may include an elastic covering which is relatively stretchable in at least a second direction generally perpendicular to that of the first direction 88 (i.e., stretchable in the direction of arrow 89). In such embodiments, there would be partial penetration (by elasticity) of any separations running perpendicular to the separations 86 (i.e., running in the direction of arrow 88) of present FIGS. 9 and 10.

It should be further understood by those of ordinary skill in the art that the foregoing presently preferred embodiments are exemplary only, and that the attendant description thereof is likewise by way of words of example rather than words of limitation, and their use does not preclude inclusion of such modifications, variations, and/or additions to the present invention as would be readily apparent to one of ordinary skill in the art, the scope of the present invention being set forth in the appended claims.

What is claimed is:

1. A patient support, comprising:

a body of resilient foam material having a predetermined thickness substantially in a range of about 6 to 9 centimeters, a density of at least about 2.5 pounds per cubic foot, a 25 percent indentation load deflection rating of at least about 50 pounds, and defining at least one main patient support surface thereon, said surface defining a plurality of independent support segments with respective separations therebetween and adjacent relatively rounded upper edges with a predetermined radius of curvature; and a stretchable covering for said body inclusive of said one main patient support surface thereof, said covering defining a base layer of woven fabric comprised of elastic synthetic fibers and a water resistant coating layer on said base layer, which is stretchable with said base layer so that said stretchable covering can stretch into separations between said independent support segments so as to permit independent action thereof whenever said patient support receives a patient on said body main patient support surface.

2. A patient support as in claim 1, wherein said base layer is stretchable at least along one major axis thereof.

3. A patient support as in claim 2, wherein said base layer comprises a two-way Rochelle knit of polyester material.

4. A patient support as in claim 2, wherein said coating layer comprises an application of urethane to said base layer.

5. A patient support as in claim 4, wherein said coating layer of urethane comprises an application of clear urethane at least about 1 mil thick.

6. A patient support as in claim 4, wherein said body of resilient foam material comprises a generally rectangular wheelchair cushion and said independent support segments comprise generally cube shaped elements.

7. A patient support as in claim 6, wherein said generally cube shaped elements have adjacent separations of at least about 3 millimeters.

8. A patient support as in claim 4, wherein said body of resilient foamed material comprises a mattress pad.

9. A patient support as in claim 8, wherein said independent support segments comprise convolutions.

10. A patient support as in claim 8, wherein said independent support segments comprise generally rectangular shaped elements with air channels therebetween.

11. A patient support as in claim 1, wherein said base layer is stretchable at least along two mutually perpendicular major axes thereof.

12. A patient support as in claim 11, wherein said base layer comprises a four-way Rochelle knit of polyester material.

13. A patient support as in claim 12, wherein said coating layer comprises an application of clear urethane at least about 1 mil thick.

14. An improved wheelchair cushion comprising a generally rectangular body of resilient foam material having a predetermined thickness substantially in a range of about 6 to 9 centimeters, a density of at least about 2.5 pounds per cubic foot, a 25 percent indentation load deflection rating of at least about 50 pounds, and an upper support surface comprised of a plurality of projections extending though about one-half the thickness of said body, said projections further having adjacent relatively rounded edges at said upper support surface with a predetermined radius of curvature for said adjacent edges of at least about 5 millimeters, and having peripheral relatively rounded edges about the periphery of said upper support surface with a predetermined radius of curvature for said peripheral edges of at least about 10 millimeters, and further having a predetermined separation distance between adjacent projections of at least about 2 millimeters, so that said plurality of projections provide improved independent action and support of a patient thereon while overall thickness of said body is relatively minimized to facilitate patient movement onto and off from a wheelchair with which said cushion is used.

15. An improved wheelchair cushion as in claim 14, wherein said predetermined body thickness is about 7.6 centimeters, said body density is about 2.8 pounds per cubic foot, said 25 percent indentation load deflection rating is about 55 pounds, said adjacent edge radius of curvature is about 10 millimeters, said peripheral edge radius of curvature is about 19 millimeters, and said separation distance is at least about 3 millimeters.

16. An improved wheelchair cushion as in claim 15, wherein said separation distance increases from about 3 millimeters relatively adjacent the base of said projections to about 5 millimeters adjacent said upper support surface.

17. An improved wheelchair cushion as in claim 14, wherein said projections comprise generally cube shaped elements having sides substantially in a range of from 3.5 to 5.5 centimeters.

18. An improved wheelchair cushion as in claim 14, further including air channels formed at the base of said respective projections and extending out to lateral side edges of said body.

19. An improved wheelchair cushion as in claim 18, wherein said air channels comprise circular channels having diameters substantially in a range of from 6 millimeters to 9 millimeters.

20. An improved wheelchair cushion as in claim 18, further including generally water resistant cover means received about said rectangular body.

21. An improved wheelchair cushion as in claim 20, wherein said cover means are removable and elastic for stretching at least part way down into separations between adjacent projections whenever a patient is seated on said cushion.

22. An improved wheelchair cushion as in claim 21, wherein said cover means includes a woven fabric base layer of elastic synthetic fibers and a water resistant coating layer of polyurethane secured to said base layer.

* * * * *